United States Patent [19]

Mazurek

[11] 4,150,765

[45] Apr. 24, 1979

[54] TAB CONSTRUCTION FOR EASY OPENING CONTAINER

[75] Inventor: Stanley L. Mazurek, Chicago, Ill.

[73] Assignee: The Continental Group, Inc., New York, N.Y.

[21] Appl. No.: 850,338

[22] Filed: Nov. 10, 1977

[51] Int. Cl.[2] ..... B65D 41/32

[52] U.S. Cl. ..... 220/269

[58] Field of Search ..... 220/268–273

[56] References Cited

U.S. PATENT DOCUMENTS

| | | | |
|---|---|---|---|
| 3,967,753 | 7/1976 | Cudzik | 220/269 |
| 3,977,561 | 8/1976 | Strobe et al. | 220/269 |
| 4,024,981 | 5/1977 | Brown | 220/269 |

*Primary Examiner*—George T. Hall

*Attorney, Agent, or Firm*—John J. Kowalik; Joseph E. Kerwin; William A. Dittmann

[57] ABSTRACT

A non-detachable tab adapted to be secured to the end panel of a container which comprises a securing lug formed from the sheet metal of the tab, the lug having an attachment to the nose portion of the lug in an area which has not been work hardened and also which has been formed to provide several axes of hinging and thereby increasing the number of times that the tab can be hinged back and forth without breaking off.

11 Claims, 9 Drawing Figures

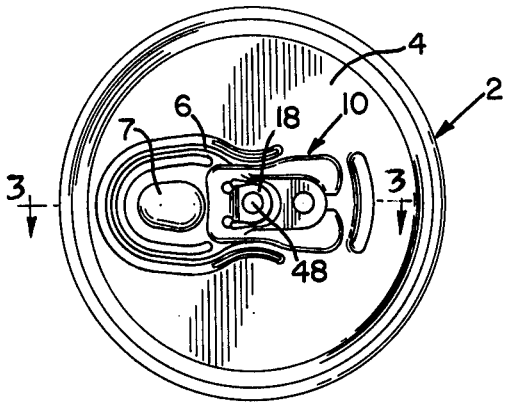
FIG. 1
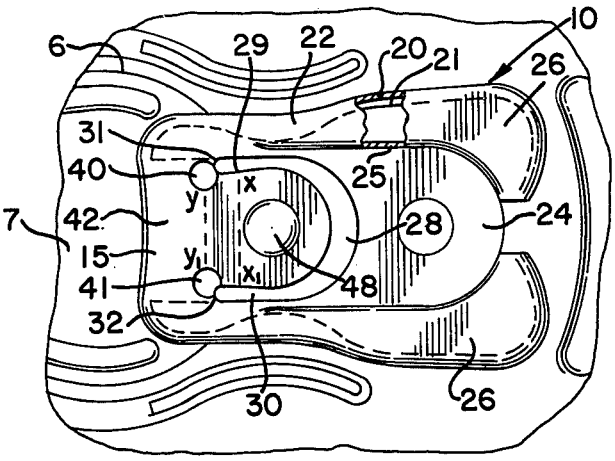
FIG. 2
FIG. 3
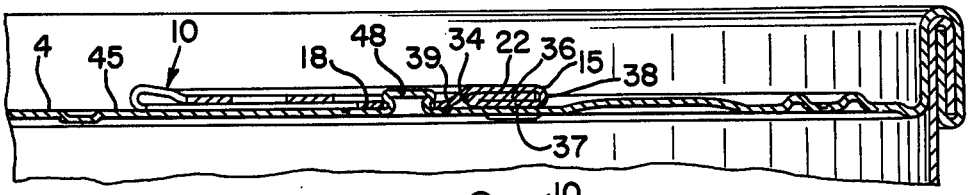
FIG. 4
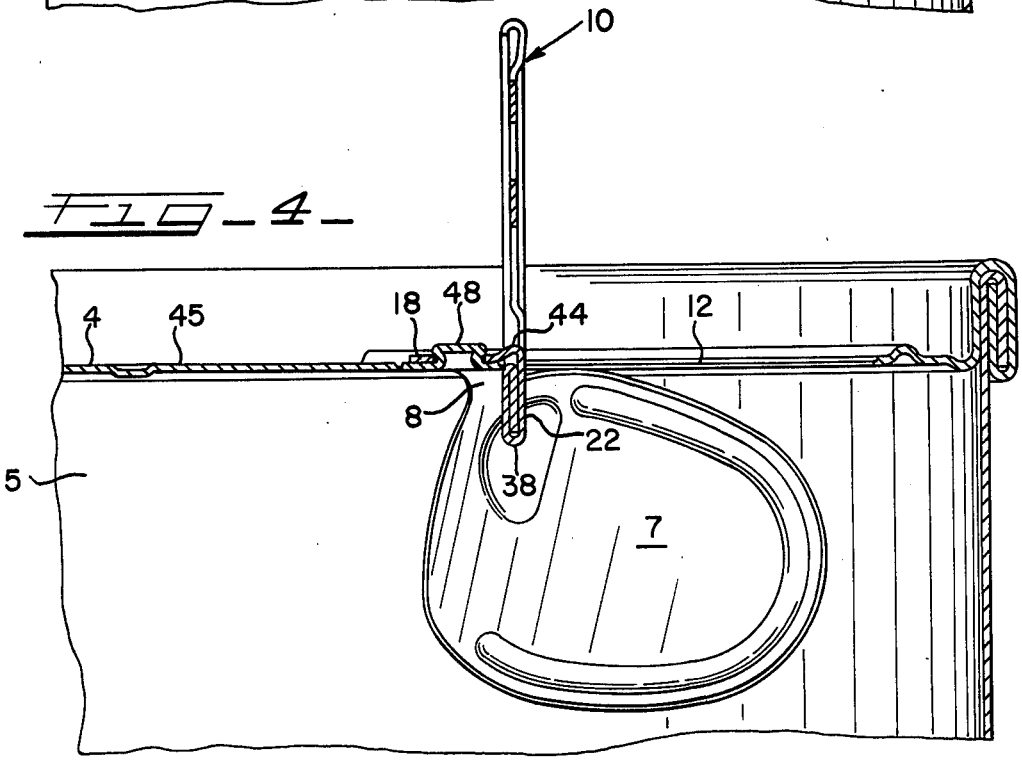

TAB CONSTRUCTION FOR EASY OPENING CONTAINER

DISCUSSION OF THE PRIOR ART

Some of the patents which are known to Applicant (U.S. Pat. No. 3,967,752 and U.S. Pat. No. 3,957,753) disclose a non-detachable tab by providing a separate dead soft aluminum attachment strip reinforcement which extends between the rivet attachment of the tab to the can end and the nose portion. What has been experienced is that if the user twists the tab he will quickly break the strip. A further problem with the tab disclosed in the above-identified U.S. patents is the cost of manufacture and the complexity of putting in a separate piece of material.

Other non-detach tab patents are U.S. Pat. Nos. 3,618,815, using two rivets; Re. 27,518, which a single hinge line is used; and 3,749,275, which also uses two rivets.

SUMMARY OF THE INVENTION

The opening of the end panel requires a tab which must be stiff against transverse bending and also flexible at the connection between the tab and end wall to permit lifting and retracting the tab without causing a fatigue crack at the connection. The invention provides a tab construction meeting these requirements although it is especially adaptable to be used in connection with the construction herein described it may also be used with other opening constructions.

This invention is directed to a novel tab construction and more particularly to the construction of the attachment area of the securing lug to the nose portion of the tab in order to enhance its bending characteristics so that the number of back and forth bends of the tab with respect to the securing lug is materially increased before the metal becomes fatigued to an extent where it will fracture.

A further object of the invention is to provide a novel tab construction in which the securing lug in its area of connection to the tab is formed to provide a plurality of bend lines so that the number of back and forth bends is materially increased.

An important object of the invention is to provide a tab construction which can be manufactured on existing equipment with minimal modification of dies and achieves increased bend life without the necessity of resorting to complex structures such as providing dual attachment members.

These and other objects and advantages inherent in and encompassed by the invention will become more readily apparent from the specification and the drawings wherein:

FIG. 1 is a top plan view of a container incorporating the invention;

FIG. 2 is an enlarged view of the tab structure and adjacent container end panel;

FIG. 3 is a cross-sectional view taken substantially under line 3—3 of FIG. 1 on an enlarged scale showing the tab in its unopened condition;

FIG. 4 shows the tab and end panel in the opened position;

Figure 5:
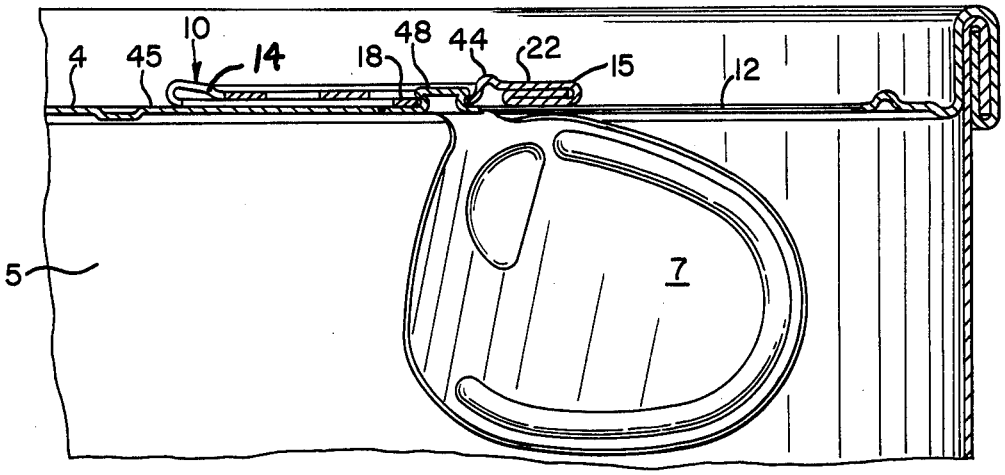
FIG. 5 is a view similar to FIG. 4 but showing the tab returned to its reset position.

Reference is made to FIGS. 1 through 5 of the drawings which illustrate one exemplary embodiment of the container, designated generally 2 which utilizes an easy open end wall 4 and a container body 5 which may be of any usual construction including the bottom wall not shown as well known to those skilled in the art.

The top wall is formed therein a score designated 6 defining an openable segment or tear-out panel and which is adapted to be moved inwardly from the position shown in FIG. 3 to that shown in FIG. 4 by means of a tab generally designated 10. It will be understood that the container in an unopened condition will have the push-in portion 7 attached around its periphery to the remainder of the end panel 4 and that upon lifting of the tab the position shown in FIG. 3 to that shown in FIG. 4 of the tear-out portion will break away from the end panel and will be pushed into the container and thereafter the tab is adapted to be returned from the upright position shown in FIG. 4 to the reset position shown in FIG. 5 where it is returned against the top of the end panel 4 to a nonobstructing position whereat the user may drink directly from the container through the opening or pour aperture 12 which is formed on the removal of the removable segment 7.

The invention is directed to the construction of the tab 10 which comprises a rear end lift portion 14 and a nose portion 15 and an intermediate portion in the form of an attachment lug 18 which extends lengthwise of the tab. The intermediate lug portion 18 is formed from the material of the tab which may be steel or preferably aluminum.

As best seen in FIG. 2 of the tab is preferably a rectangular structure and along its lateral longitudinal edges is curled to provide a vertical outboard flange 20 and an inturned bottom flange 21 which is flattened against the underside of the top wall portion 22 of the tab. Also the center portion 24 of the tab body is offset downwardly which also creates a vertical flange 25 along the inner edge of each lateral longitudinal leg 26,26 of the tab thus providing a rigid structure.

The depression terminates intermediate the ends of the securing lug or mounting ear 18, lug 18 being cut out of the panel portion 24 by means of a U-shaped cut-out 28 which has its bight portion remote from the nose portion 15 of the tab. The legs of the cut identified at 29 and 30 extend forwardly of the leg portions 26,26 and have forward ends 31 and 32 which align with the rear edge 34 of the intermediate and bottom metal plies 36 and 37 of the nose portion 15 which nose portion is formed at its leading end 38 by the fold between the bottom ply 37 and the top wall 22 of the tab. It will be observed from a consideration of FIG. 3 that the forward end of the lug 18 has an upwardly and forwardly sloping end portion 39 which has been work hardened. It is in this area that the ends 31 and 32 of the cut-outs legs 29 and 30 terminate. Forwardly of these legs there are provided intersecting circular cut-outs 40 and 41 which extend into the portion of the top wall 22 which forms the top wall section 42 of the nose portion. This region of the nose is a portion of the metal which has not been work hardened and therefore may be flexed back and forth many times more than the area of the wall portion 39 before fatigue failure occurs.

A feature of the invention is to provide multiple bend lines for the attaching lugs 18. On the initial lifting of the rear or fingerlift portion 10 of the tab the lug 18 or connecting strap will normally bend almost immediately in front of the rivet 48 along the line X—X and upon lifting of the tab as shown in FIG. 4 the forward end of the connecting strap will deform as seen in FIG. 4 whereat an upward curl identified at 44 will develop. When the tab is returned to its retract position against the top 45 of the end panel 4 as best seen in FIG. 5 the curl at 44 will remain. However, a new bend line will be established between the opnings 40 and 41 which are spaced a distance lesser than the spacing between the adjacent edges of the leg portions 29 and 30 of the cutout. Thus, the weakest and the most flexible section of the tab will provide a bend line Y—Y at the portion of the connecting strap 18 which has not been work hardened. Thus, repeated flexing back and forth will take place primarily along the bend line Y—Y although there will be some shifting of the bend line because of the curl 44 and thus the repeated bending back and forth of the tab defined along a single line in the prior art will be minimized or eliminated.

Figure 6:
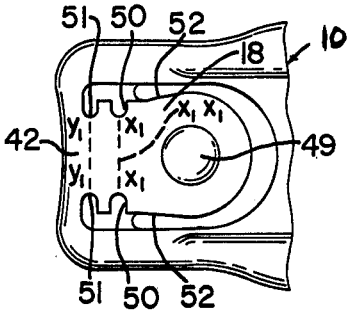
FIG. 6 illustrates a portion of the tab in plan view of another embodiment.
Figure 8:
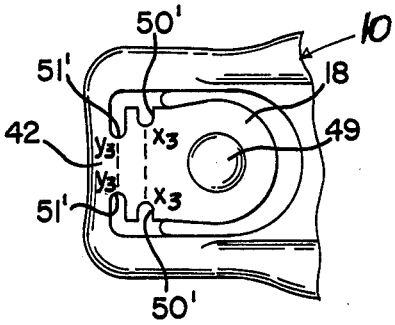
FIG. 8 is a fragmentary plan view of a tab showing another embodiment.
Figure 7:
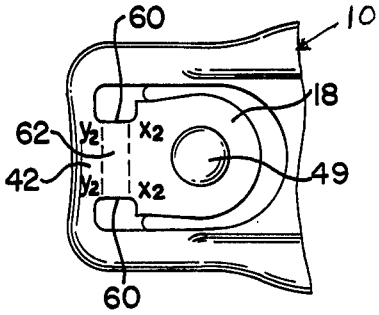
FIG. 7 is a further fragmentary plan view of the tab showing a still further embodiment.

In FIGS. 6 through 9 identical parts will be identified with the same reference numerals and it will be seen, for example, in FIG. 6 that in lieu of the round openings 40,41, the forward end of the connecting strap 18 is provided with notches 50,50 and 51,51, the notches 50,50 being at opposite edges of the leading edges 52 of the lug in the region of the wall portion 42 and that bending will take place along bend line $X_1$—$X_1$ initially and then along $Y_1$—$Y_1$ and shift back and forth. FIG. 7 illustrates providing wide rectangular or quadrilateral shaped notches 60,60 in the wall region 42 of the tab 18 across the narrow width 62. In FIG. 8 the notches 50' and 51' are arranged in similar fashion as in FIG. 6 with reference to the notches 50 and 51 and define the bend lines $X_3$—$X_3$ and $Y_3$—$Y_3$. It will be observed that the rear notches 50',50' are not as deep as the front notches 51',51' whereby the tab is of narrowest width at its front end and then it has an intermediate narrow width and the remainder of the tab is wider where it is attached at its rear end to the rivet 49 which is formed on the end panel the same as on all previous embodiments.

Figure 9:
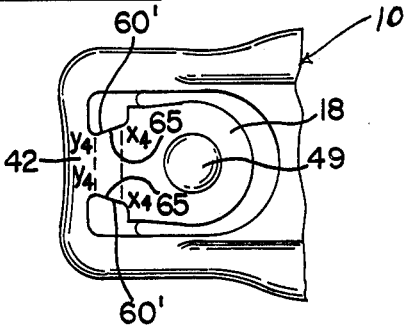
FIG. 9 is a fragmentary plan view of the tab showing a still further embodiment.

In FIG. 9 the arrangement is similar to the arrangement of FIG. 7 and the two notches 60',60' are formed to provide tapering edges 65,65 and the edges taper toward the front end of the connecting strap in the region of the wall portion 42 and provide the hinge lines $Y_4$—$Y_4$ and $X_4$—$X_4$. This structure functions essentially in the same manner as the previous embodiment. In other words, initial bending will occur along the X axes and the subsequent bending will take place along the Y axes in the region of the nonworked portion of the material of the tab.

Several embodiments of the invention have been described and it will be realized that various modifications will become apparent to those skilled in the art which are intended to be covered by the appended claims.

What is claimed is:

1. A tab for easy opening containers comprising a tab body having means at one end particularly adapted for applying an inwardly directed rupturing pressure on the container panel when the opposite end is moved outwardly, said tab having a bendable mounting ear positioned intermediate its ends for connection to the end panel, and means providing a plurality of hinge axes on said ear for accommodating shifting the bend of the ear from one axis to another attendant to back and forth ear bending movements of said tab and thus impeding fracture of the ear and thereby removal of the tab from the container.

2. The invention according to claim 1 and said one end of the tab comprising a nose portion having a nonwork hardened section and at least one of said hinge axes being located in said section.

3. The invention according to claim 2 and said mounting ear having a narrower than elsewhere width portion adjacent to said nonwork hardened section.

4. The invention according to claim 1 and said ear having side edges with a plurality of notches at each side edge thereof defining several of said hinge axes.

5. The invention according to claim 1 and said ear having side edges with at least one notch in each edge defining at least one of said hinge axes.

6. The invention according to claim 5 and said notches each defined by an inner edge and said inner edges converging toward said one end of the tab.

7. The invention according to claim 1 and said means comprising a portion at the forward end of the tab each sloping upwardly toward said one end of the ear and adapted to ear during hinging movement between the tab and ear.

8. The invention according to claim 1 and said tab being made of thin one piece sheet metal.

9. The invention according to claim 8 and said metal being aluminum.

10. An easy opening container end with nondetachable means for making an opening therethrough suitable for pouring comprising:

A tab having work hardened means at one end for rupturing said end and a nonwork hardened section and having a lift portion at the other end for lifting the tab and pressing said one end against said container end, and attaching means on the container end and said tab for securing the tab to said container end and comprising a securing lug on the tab, and at least one selected hinging axis of connection between the said lug and tab in a nonwork hardened section of the tab at said one end.

11. The invention according to claim 10 and said tab having a central depressed body section and said lug being cut from said body section.

* * * * *

UNITED STATES PATENT AND TRADEMARK OFFICE

CERTIFICATE OF CORRECTION

PATENT NO. : 4,150,765

DATED : April 24, 1979

INVENTOR(S) : Stanley L. Mazurek

It is certified that error appears in the above-identified patent and that said Letters Patent are hereby corrected as shown below:

In claim 1, line 3, after "pressure on" change "the" to --a--; line 7, after "means" insert --on said ear--.

In claim 7, line 4, cancel "ear" and insert --bend--.

In claim 10, line 4, cancel "A tab" and insert --a tab--.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*